United States Patent [19]

Moore et al.

[11] 4,126,448

[45] Nov. 21, 1978

[54] SUPERPLASTIC ALUMINUM ALLOY PRODUCTS AND METHOD OF PREPARATION

[75] Inventors: David M. Moore, Kingston; Larry R. Morris, Yarker, both of Canada

[73] Assignee: Alcan Research and Development Limited, Montreal, Canada

[21] Appl. No.: 783,301

[22] Filed: Mar. 31, 1977

[51] Int. Cl.[2] ..... C22C 21/10

[52] U.S. Cl. ..... 75/146; 29/527.7; 75/141; 148/2; 148/11.5 A; 148/32

[58] Field of Search ..... 75/146, 141; 148/2, 148/11.5 A, 32, 32.5; 29/527.7

[56] References Cited

U.S. PATENT DOCUMENTS

| | | | |
|---|---|---|---|
| 1,932,836 | 10/1933 | Wood et al. | 75/146 |
| 3,989,548 | 11/1976 | Morris | 148/2 |

*Primary Examiner*—R. Dean

*Attorney, Agent, or Firm*—Cooper, Dunham, Clark, Griffin & Moran

[57] ABSTRACT

Aluminum alloy products having superplastic properties are prepared by casting an aluminum alloy containing calcium and zinc in near-eutectic proportions under conditions that develop a eutectic cast structure of fine Ca-Zn-Al intermetallic rods, and working the cast alloy mass to break up the rods into particles having an average diameter of less than two microns.

12 Claims, 1 Drawing Figure

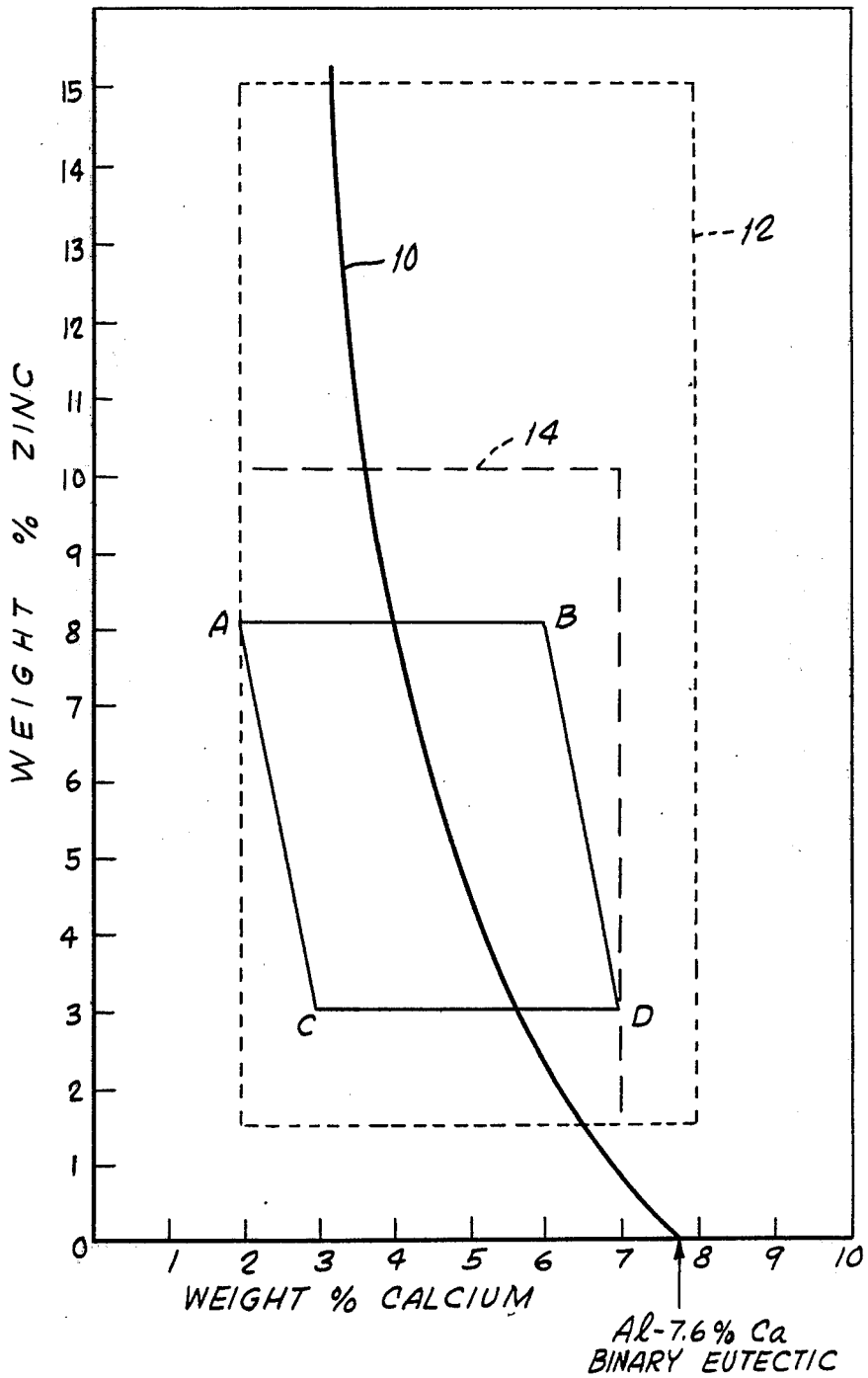
WEIGHT % ZINC
WEIGHT % CALCIUM
10
12
14
A
B
C
D
Al-7.6% Ca
BINARY EUTECTIC

SUPERPLASTIC ALUMINUM ALLOY PRODUCTS AND METHOD OF PREPARATION

BACKGROUND OF THE INVENTION

This invention relates to aluminum alloy products having superplastic properties, and to methods of preparing such products.

Superplastic alloys are characterized by elevated-temperature forming properties somewhat similar to those of plastics and glass. That is to say, at temperatures within a superplastic forming range (determined by the composition of the alloy), these alloys are able to undergo extensive deformation under small forces without fracture or failure by necking or center voids; for instance, unlike ordinary sheet metal, superplastic alloy sheet at forming temperatures can be formed into complex shapes by blow molding with compressed air at relatively low pressure. Two criteria currently applied to define superplasticity are the properties (at forming temperatures) of tensile elongation of at least 200% and strain rate sensitivity index $m$ of at least 0.3, although alloys which attain somewhat lesser values (e.g. elongation of at least about 100%) may nevertheless be usefully superplastic for many purposes, and will be understood to be included within the term "superplastic alloys" as used herein.

Several superplastic alloys are known, and have been found to have utility in making metal parts of configurations difficult to produce by conventional techniques. One such alloy is a zinc-based alloy containing 22% aluminum (all percentages herein being expressed as percent by weight unless otherwise specifically indicated). Another, an aluminum-based alloy containing 6% copper and 0.5% zirconium, is advantageous for various applications in that it is lighter in weight, and has better creep resistance and surface finish, than the zinc-based alloy, but it is relatively difficult to produce and somewhat susceptible to corrosion. The binary eutectic alloy of aluminum with 7.6% calcium is also superplastic, but cannot readily be cold-worked owing to its brittleness.

SUMMARY OF THE INVENTION

The present invention broadly embraces the discovery that aluminum alloys containing calcium and zinc, in proportions relatively close to a ternary eutectic composition, can develop useful superplastic properties when cast and worked in a particular manner as hereinafter described; and that superplastic products of these alloys, in addition to having the attributes of light weight and superior creep resistance and surface finish characteristic of other superplastic aluminum alloys, are advantageously easy and economical to produce and afford improved corrosion resistance as well as satisfactory cold working properties.

Alloy compositions suitable for the practice of the invention in this broad sense are those consisting essentially of 2 to 8% Ca, 1.5 to 15% Zn, not more than 2.0% each of Mg, Si, Mn and Cu, not more than 1.0% each (2% total) of other elements, balance aluminum. Preferred upper limits are 7% Ca, 10% Zn, 1.0% each for Si and Mn, 0.2% each for Cu and Mg, 0.5% each (1.0% total) for Fe, Ti, V, Cr, Zr, and Sr, 0.25% each (1.0% total) for other elements. An especially preferred composition, which itself constitutes an important specific feature of the invention, has proportions of Ca and Zn within the coordinates 2.0% Ca, 8.0% Zn; 6.0% Ca, 8.0% Zn; 3.0% Ca, 3.0% Zn; and 7.0% Ca, 3.0% Zn.

Applicants have discovered that when an alloy of the foregoing composition is cast with rapid solidification so that coupled growth occurs, the structure of the cast mass includes, in an aluminum matrix, a substantial volume fraction (10 to 30 volume percent) of fine eutectic rods of at least one ternary Ca-Zn-Al intermetallic compound, formed from the melt in the casting operation and having an average diameter of 0.05–1.50 microns. The rods are breakable, upon working of the cast mass, into particles having an average particle diameter of less than two microns. These particles contribute to the attainment of superplasticity in the products of the invention by maintaining a fine grain size at forming temperatures.

Accordingly, the method of the invention broadly comprises the steps of casting an alloy having the foregoing composition under conditions for producing a cast mass which includes, in an aluminum matrix, a substantial volume fraction of fine eutective Ca-Zn-Al intermetallic rods; and working the cast mass sufficiently to break up the rods into particles having an average particle diameter of less than two microns. Preferably, the working step includes cold working by an amount equal to at least about 60% cold reduction. The product of this method is an alloy article, e.g. in sheet form, having useful superplastic properties so as to be capable of undergoing extensive deformation (by blow molding or otherwise) at forming temperatures ranging from about 300° C. to about 600° C. (preferably about 400°–500° C.).

Further features and advantages of the invention will be apparent from the detailed description hereinbelow set forth, together with the accompanying drawing.

BRIEF DESCRIPTION OF THE DRAWING

The single FIGURE is a graph illustrating broad and preferred Al-Ca-Zn alloy composition ranges for the practice of the present invention, and showing the relationship of these ranges to the eutectic trough of the ternary Al-Ca-Zn system.

DETAILED DESCRIPTION

The method of the present invention, for making Al-Ca-Zn products which exhibit superplastic properties, involves both particular features of alloy composition and the performance of certain steps on alloys having those features.

The pertinent features of composition may be explained with reference to the accompanying drawing. It has been discovered that for the ternary system Al-Ca-Zn, i.e. the system of alloys constituted of a major proportion of aluminum with calcium and zinc as principal alloying elements, there exists a eutectic trough or valley, which is represented in the drawing by line 10. Applicants have further discovered that Al-Ca-Zn alloys having a composition relatively close to this eutectic trough are castable to produce a cellular eutectic structure including, in an aluminum matrix, a substantial volume fraction (10 to 30 volume percent, and in typical instances about 18 to about 23 volume percent) of fine eutectic rods of one or more Ca-Zn-Al intermetallic compounds, formed from the melt in the casting operation, having an average diameter of 0.05–1.50 microns, and breakable (upon working of the cast mass) into particles having an average particle diameter of typically less than 2 microns. It is at present believed that this intermetallic phase is $(CaZn)Al_2$ as distinct from the brittle $CaAl_4$ phase found in the binary Al-Ca alloy.

In the broadest sense, the method of the invention may be practiced with alloys having proportions of Ca and Zn within the limits defined by the broken line rectangle 12 in the drawings, viz. 2–8% Ca and 1.5–15% Zn. That is to say, although the best superplastic properties are exhibited by alloy products having compositions close to the eutectic trough, decreasing but still useful superplastic properties are attainable with compositions lying to the left or right of the trough, i.e. within the broad limits of rectangle 12.

In particular, the degree of superplasticity attainable decreases progressively with decreasing Ca content, until at levels of Ca below 2% the volume fraction of the eutectic structure becomes too small to provide useful superplastic behavior. Increase in Ca content to the right of the eutectic valley as seen in the drawing tends to result in formation of coarse primary intermetallic crystals, which are undesirable as they cause premature fracture during forming operations. Coarse primaries can be somewhat suppressed by increasing the casting temperature, but this expedient becomes very difficult with compositions containing more than 8% Ca. As indicated by broken-line rectangle 14, a preferred upper limit of Ca content is 7%.

Alloys containing less than 1.5% Zn may be superplastic but they are very brittle and tend to crack badly during bending and/or cold rolling; alloys containing more than 10 to 15% Zn may also be superplastic but have very poor corrosion resistance. The variation of superplasticity (in terms of percent tensile elongation at forming temperature) with zinc content is such that the best superplastic properties are attainable by compositions containing less than about 8.5% or more than about 12.5% Zn, and in view of the reduced corrosion resistance of the higher zinc alloys, a zinc content in the lower portion of the broad range affords an advantageous combination of superplasticity and corrosion resistance. As rectangle 14 (which defines a currently preferred range of proportions of Ca and Zn) further indicates, 10% is a preferred upper limit of Zn content.

The most preferred range of Ca and Zn proportions, affording the best combination of superplastic behavior, corrosion resistance, and resistance to cracking at room temperature, is that defined by the figure ABCD in the drawing, viz. alloys having proportions of Ca and Zn lying within the coordinates 2.0% Ca, 8.0% Zn; 6.0% Ca, 8.0% Zn; 3.0% Ca, 3.0% Zn; and 7.0% Ca, 3.0% Zn.

With the exception of Si, Mn, Cr, Cu, Zr and Sr, impurities and minor additions of elements other than Ca and Zn tend to coarsen the as-cast eutectic structure and are thus undesirable. Mg levels over 0.25% lead to cracking during cold rolling, while Cu levels over 0.2% reduce corrosion resistance. Again stated broadly, the upper limits of additions and impurities in alloys suitable for the practice of the invention are 2.0% each of Mg, Si, Mn, and Cu; other elements, 1.0% each, 2% total. Preferably, however, the following maxima are observed:

Si, Mn: 1.0% each
Cu, Mg: 0.2% each
Fe, Ti, V, Cr, Zr, Sr: 0.5% each/1.0% total
Other: 0.25% each/1.0% total An especially preferred alloy composition is that consisting essentially of Ca and Zn within the ranges of proportions defined by the figure ABCD, with additions and impurities within the above-specified preferred maxima, balance aluminum.

As stated, Al-Ca-Zn alloys having compositions within the broad or preferred limits set forth above are capable of developing a cast structure of fine eutectic Ca-Zn-Al intermetallic rods which, upon working, break up into particles that impart superplasticity to the alloy product. The method of the invention includes the steps of casting the alloy in such manner as to produce the requisite cast structure, and then working the cast mass to fragment the rods into the desired particles.

These steps may be performed by applying, to an Al-Ca-Zn alloy of the above-defined composition, procedures of the type generally described in U.S. Pat. No. 3,989,548, issued November 2, 1976, the disclosure of which is incorporated herein by this reference.

As set forth in that patent, the most convenient method for producing rod-like intermetallic phases in an aluminum mass is to cast a eutectic alloy, incorporating alloying elements which form intermetallic phases with aluminum on solidification, under selected casting conditions to produce a fine coupled growth structure. That phenomenon is well known and is explained in an article by J. D. Livingston in *Material Science Engineering*, Vol. 7 (1971), pp. 61–70.

The Al-Ca-Zn eutectic, when cast by the direct chill process or similar continuous or semicontinuous casting process, produces a rod-like eutectic structure. For the purpose of the present invention, there is no requirement that the rod-like phases should be aligned with the axis of the cast mass. Indeed, it is preferable that they should be unaligned. In consequence, the ingots may be produced by conventional direct chill continuous casting under conditions selected to ensure coupled growth of the intermetallic phase in fine rods in the matrix composed of the more ductile aluminum. Very satisfactory superplastic products can be achieved provided that the cast mass is produced in such a manner that the intermetallic phase grows in the form of fine closely spaced rods that can be broken up by subsequent working to produce a uniform dispersion of fine intermetallic particles which are on an average less than 2 microns in diameter. These particles tend to coarsen somewhat during superplastic forming.

In contrast to these particles, coarse primary intermetallic particles are generally in the form of faceted polyhedra, resulting from nucleation ahead of the solidification front in a mass of alloy being cast, and range upwardly in size from about 3 microns, and typically upwards of 10 microns. In the practice of the present invention, the cast alloy is considered to be essentially free of such coarse primary particles (as is desired) when the volume of coarse primaries therein is not more than 2%.

The average particle diameter is determined by counting the number of particles present in unit area in a micrograph of a cross section, ignoring coarse primary intermetallic particles and fine particles that are precipitated from solid solution. Such particles are easily recognizable by an experienced metallurgist. The average particle diameter is then given by the following formula:

$$d = 1.13\sqrt{V/Np}$$

where:

$d$ = particle diameter $Np$ = number of particles per unit area

V = volume fraction of intermetallics.

The above formula, taken from H. Modin and S. Modin, *Metallurgical Microscopy,* trans. G. G. Kinnane (London: Butterworths, 1973), p. 164, expresses the size of the particles in terms of the diameter of a sphere of equal volume. The diameter of an elongated particle formed by segmenting a cylindrical rod is, when expressed in these terms, usually larger than the diameter of the rod from which it formed.

Since there is no requirement for the coupled phases to be aligned in a single direction, it is unnecessary to suppress the formation of eutectic cellular growth (caused by the segregation of impurities), and therefore commercial purity aluminum metal can be used for the production of the cast alloy. This cellular or "colony" mode of solidification produces unaligned intermetallic rods. In producing the cast alloy, the metal should be cast under such conditions that substantially no nucleation of intermetallics occurs in the molten metal in advance of the front between the liquid metal and solid metal, i.e. so that the cast alloy will be essentially free of coarse primary particles; to achieve this requirement for suppression of the growth of primary particles, there must be a temperature gradient of at least 5° C./cm in the molten metal in the immediate vicinity of the solidification front. Also, the growth rate (rate of deposition of solid metal in a direction substantially perpendicular to the solidification front) should be at least 1 cm/minute. Thus it will be seen that the requirements of the casting procedure are such that, as already stated, ingots having the desired characteristics may be produced by the conventional direct chill ("D.C.") continuous casting process in which coolant is applied direct to the surface of the ingot as it emerges from an open-ended mold or by twin-roll casting processes such as the "Hunter-Engineering" process. Unsatisfactory structures are produced by sand casting and permanent mold casting and other processes that produce a nonuniform microstructure. The direct chill continuous casting process, particularly when employing a hot-top mold in conjunction with a glass-cloth distributor, permits the maintenance of relatively stable conditions in the vicinity of the solidification front, while applying a heavy chill to the solidified metal by the application of coolant to the surface of the ingot emerging from the mold and at the same time introducing fresh molten metal to the mold. This enables the desired high growth rate to be achieved in conjunction with provision of a steep thermal gradient in the immediate vicinity of the solidification front, as required for coupled growth of metal matrix and intermetallic phase without formation of coarse primary intermetallic particles.

When the cast alloy is deformed by working, the intermetallic rods are not fractured haphazardly but tend to segment evenly along their length, creating uniform but somewhat elongated particles whose diameter corresponds to the diameter of the original intermetallic rods. These particles tend to disperse themselves evenly throughout the ductile metal matrix during the subsequent deformation of the ingot. The aspect ratio (ratio of length to diameter) of the majority of particles formed by the disintegration of the intermetallic rods falls in the range of 1:1 to 5:1. By contrast, the average length of the rod-like intermetallics in the cast alloy is usually substantially more than 100 times the diameter.

Having produced a cast alloy of the necessary structure, the breakdown of the brittle intermetallic phase into dispersed particles less than 2 microns in average diameter may be achieved by either hot and/or cold working the cast alloy in a variety of ways. A reduction of at least 60% is required for the necessary dispersion of the particles formed by the breakdown of the intermetallic rods. While care must be taken that time/temperature conditions selected for the preliminary heating of the ingot before hot working do not result in the coalescence of the intermetallics, there is little difficulty in the selection of satisfactory conditions. In the production of rolled products (e.g. sheet suitable for subsequent superplastic deformation), it is preferred to perform the major part of the reduction of the initial ingot by hot rolling, but it is also preferable to apply a subsequent cold-rolling operation. Indeed, stated generally, it is preferable (though not necessary) that the working step include final cold working in an amount equal to at least about 60% cold reduction. By the term "cold working," it should be understood that the alloy has been subjected to working at a temperature below about 250° C.

No soaking or homogenization of the ingot is necessary before hot rolling, and preheating for hot rolling should be kept to a minimum. Hot rolling temperatures of about 400° to about 500° C. have been found satisfactory; use of lower hot rolling temperatures (within this range) tends to reduce particle coarsening. Subsequent cold rolling can be performed without interannealing, and no treatment is needed after cold rolling, since the as-rolled sheet has the required superplastic microstructure.

Products such as sheet prepared by the above described method may be subjected to forming at temperatures in a broad range between about 300° C. and about 600° C. with at least partial realization of the advantages of superplasticity, although the preferred forming temperature range is about 400° C. to about 500° C., for assured attainment of fully superplastic properties. In this regard, it may be explained that fully superplastic behavior is usually associated with tensile elongation of 200% or greater; however, tensile elongations obtained in practice depend very much upon the shape and form of the tensile test piece. With thin test pieces, such as those used to obtain the data given in the examples set forth below, it is considered that tensile elongations in excess of about 150% indicate full superplasticity, and that elongations of at least about 100% show sufficiently increased or extended ductility over and above normal commercial aluminum alloys to be considered useful as superplastic materials and to be embraced within the term "superplastic alloys" as used herein.

Typical conditions for superplastic forming of shapes from a sheet alloy product of the present invention are as follows: gauge 0.040 inch, temperature 450° C., pressure 75 p.s.i., time 2 minutes. The blanks (sheets to be formed) are usually preheated (e.g. to 450° C.) to ensure an even temperature distribution, but successful forming has been achieved starting with cold blanks.

The alloy products of the invention, e.g. sheet, can be superplastically formed by blow-molding using equipment and techniques heretofore known and used for forming other superplastic alloys, at temperatures within the above specified forming range. The room temperature mechanical properties of the articles thus produced vary to some extent depending on the time and temperature of the forming operation (increase in forming time and temperature decreases yield strength and ultimate tensile strength and increases elongation), but typical properties are as follows: 0.2% yield strength, 21–27 thousand lbs./in.$^2$ (k.s.i.); ultimate tensile strength, 25–28 k.s.i.; elongation (2 in.) 13–19%. These properties allow conventional cold forming after superplastic forming.

The creep resistance of the alloy products of the present invention is found to be similar to that of other aluminum alloys, i.e. very much better than zinc-based alloys. In addition, these products exhibit good corrosion resistance, as determined by neutral salt spray and tap water pitting tests.

By way of further illustration of the invention, reference may be made to the following specific examples:

EXAMPLE 1

An alloy containing 5.0% Ca, 4.8% Zn was prepared from super-purity-based Al and commercial purity Ca and Zn and cast in the form of a 3-¾ inch × 9 inch D.C. ingot using a glass cloth screen in the mold. Casting speed was 4 in. per minute and casting temperature 700° C. The ingot was scalped ¼ in. on each face, hot rolled at 490° C. to ¼ in. thickness, and then cold rolled to 0.040 in. or 0.025 in. final thickness. The resultant sheet was superplastic in the temperature range 450° C. to 500° C. as judged by the following measurements:

(1) Strain rate sensitivity index "*m*"; values of 0.3 were obtained at both 450° C. and 500° C. measured in hot tensile tests on 2-in. gauge length sheet specimens at an initial strain rate of $2 \times 10^{-3}$ sec.$^{-1}$.

(2) Tensile elongation, values of 232% and 267% were measured at 450° C. and 500° C. respectively, using sheet tensile specimens of 2-in.-gauge length tested at a strain rate of $3 \times 10^{-2}$ sec.$^{-1}$.

(3) Shapes such as hemispherical domes were formed at 450° C. by low pressure compressed air forming; e.g. a sheet of 0.024 in. thickness was formed at a pressure of 20 p.s.i. at 450° C. to a dome in a time of 50 seconds.

EXAMPLE 2

An alloy containing 4.94% Ca, 5.25% Zn was prepared from commercial purity Al containing 0.16% Fe and 0.07% Si and from commercial grade calcium. The alloy was cast in the form of a 5 in. × 20 in. × 40 in. D.C. ingot using similar casting conditions to those described in Example 1. The ingot was scalped ⅜ in. on each face, hot rolled to ¼ in. gauge, and cold rolled to various final gauges in the range 0.060 in. to 0.015 in. This sheet exhibited superplastic behavior. The strain rate sensitivity index, *m*, was measured by means of a blow molding technique as described by Belk, *Int. J. Mech. Sci.*, Vol. 17, p. 505 (1975). Values of *m* ranged between 0.26 and 0.37 over the range of testing temperatures from 375° C. to 525° C.

After superplastic forming at 450° C., this alloy exhibited room temperature mechanical properties as follows:

0.2% yield strength: 23.1 k.s.i.
Ultimate tensile strength: 26.0 k.s.i.
Elongation: 19%

EXAMPLE 3

Alloys containing approximately 5% Ca, 5% Zn, and various third element additives were cast in the form of 3½-in. × 9-in. D.C. ignots and fabricated to sheet in the manner described in Example 1. The compositions and values of *m* at 450° C. of these alloys are listed in Table I.

TABLE I

Superplasticity Parameter, m, at 450° C for the Alloys of Example 3

| Example | Composition (Wt %) Ca | Zn | Other | Remainder | m |
|---|---|---|---|---|---|
| A | 4.73 | 4.81 | 0.5 Mn | Al | 0.29 |
| B | 4.78 | 5.0 | 0.26 Mn | " | 0.33 |
| C | 5.23 | 5.00 | 0.10 Zr | " | 0.28 |
| D | 5.13 | 4.88 | 0.45 Cr | " | 0.22 |
| E | 5.33 | 4.97 | 0.073 Mg | " | 0.32 |
| F | 5.0 | 5.0 | 0.2 Mg | " | 0.51 |
| G | 5.00 | 4.98 | 0.21 Cu | " | 0.34 |

EXAMPLE 4

An alloy containing 5.0% Ca and 5.0% Zn was cast in the form of a 7-in.-diameter D.C. extrusion ingot using similar casting conditions to those given in Example 1. The ingot was preheated to approximately 500° C. and extruded to a tubular section with an external diameter of 1-5/16 in. and an internal diameter of 1 in. This section was then cold drawn down to a tube of external diameter of 1 in. and an internal diameter of 13/16 in. This cold-drawn tube exhibited superplastic behavior at 450° C. as evidenced by the ability to expand the tube into a mold by compressed air pressure of only 80 psi in a time of 15 minutes.

EXAMPLE 5

An alloy containing 4.0% Ca and 4.0% Zn was cast in the form of a 3½ in. × 9 in. D.C. ingot and fabricated to sheet in the manner described in Example 1. Tensile tests were carried out at 450° C. using 1-in.-gauge-length test pieces. At a strain rate of $1.67 \times 10^{-3}$ sec.$^{-1}$, an elongation of 226% was recorded, thus indicating the fully superplastic nature of the alloy.

EXAMPLE 6

An alloy containing 4.94%, Ca, 5.25% Zn was prepared from commercial purity Al containing 0.16% Fe and 0.07% Si and from commercial grade calcium. The alloy was cast in the form of a 5 in. × 20 in. × 40 in. D.C. ingot using similar casting conditions to those described in Example 1. The ingot was scalped ⅜ in. on each face and was hot rolled to ¼-in. gauge. Tensile specimens cut from this plate tested at 450° C. at a strain rate of $3 \times 10^{-2}$ sec.$^{-1}$ exhibited an elongation of 408% without failure, thus confirming the superplastic nature of the as-hot-rolled product.

EXAMPLE 7

Samples of the ¼-in.-thick plate described in Example 6 were stamped into 1¼-in. diameter blanks (or "slugs"). These were inpact extruded at room temperature to closed end cylinders 1-¼ in. in diameter and approximately 4 in. long. These cylinders exhibited superplastic behavior, demonstrated by the fact that they could be expanded into complex shapes at 450° C. using compressed air at 60 p.s.i. pressure.

EXAMPLE 8

The alloys listed in Table II were cast as 3½ in. × 9 in. D.C. ingots. These were hot rolled to ¼ in. thickness and then cold rolled to 0.040 in. thickness. Tensile tests were carried out at 450° C. at a strain rate of $5 \times 10^{-3}$ sec.$^{-1}$ and the elongations shown in Table II measured.

TABLE II

| Alloy | % Ca | % Zn | % Elongation |
|---|---|---|---|
| 1 | 1.0 | 5.0 | 65 |
| 2 | 3.5 | 5.0 | 198 |
| 3 | 5.0 | 5.0 | 300 |

These results show that whereas 1% Ca is insufficient to confer superplastic properties, additions of 3.5% and 5.0% Ca both confer superplastic behavior, the latter composition being superior.

It is to be understood that the invention is not limited to the features and embodiments hereinabove specifically set forth, but may be carried out in other ways without departure from its spirit.

We claim:

1. A method of preparing a superplastic aluminum alloy product, comprising (a) casting an alloy consisting essentially of 2–8% Ca, 1.5–15% Zn, up to 2% each of Mg, Si, Mn and Cu, up to 2% total (up to 1.0% max. each) of other elements, balance Al, for producing from a melt of the alloy a cast mass which includes, in an aluminum matrix, fine eutectic Ca-Zn-Al intermetallic rods formed from the melt in the casting operation; and (b) working the cast mass for breaking up the rods into particles having an average particle diameter of less than two microns such that the worked mass, when heated to a forming temperature between about 400° and 500° C., is superplastic.

2. A method according to claim 1 wherein the Ca content of the alloy is not more than 7% and the Zn content of the alloy is not more than 10%.

3. A method according to claim 1 wherein the alloy consists essentially of 2–7% Ca, 1.5–10% Zn, up to 1.0% each of Si and Mn, up to 0.2% each of Cu and Mg, up to 1.0% total (up to 0.5% max. each) of Fe, Ti, V, Cr, Zr and Sr, up to 1.0% total (up to 0.25% max. each) of other elements, balance Al.

4. A method according to claim 3, wherein the content of Ca and Zn in the alloy is such that on a rectangular graph of % Zn plotted against % Ca the point representing said content lies within the area of a quadrilateral defined by the coordinates 2.0% Ca, 8.0% Zn; 6.0% Ca, 8.0% Zn; 3.0% Ca, 3.0% Zn; and 7.0% Ca, 3.0% Zn.

5. A method of preparing a superplastic aluminum alloy product, comprising (a) casting an alloy consisting essentially of 2–8% Ca, 1.5–15% Zn, up to 2% each of Mg, Si, Mn and Cu, up to 2% total (up to 1.0% max. each) of other elements, balance Al, by a continuous casting process, at a growth rate of at least 1 cm/minute at the solidification front, for producing from a melt of the alloy a cast mass which includes in an aluminum matrix, at least 10 volume percent fine eutectic Ca-Zn-Al intermetallic rods formed from the melt in the casting operation with an average diameter in the range of 0.05–1.50 microns and for suppressing the growth of coarse primary intermetallic particles such that the cast mass is essentially free of said coarse primary particles; and (b) working the cast mass for breaking up the rods into particles having an average particle diameter of less than two microns such that the worked mass, when heated to a forming temperature between about 400° C. and 500° C., has a tensile elongation of at least about 200% and a strain rate sensitivity index of at least about 0.3.

6. A method according to claim 5, wherein the working step includes cold working by an amount equal to at least about 60% reduction.

7. A method according to claim 5, wherein the working step comprises rolling to produce a sheet of the alloy product, and further including the step of deforming at least a portion of the sheet by blow-molding while maintaining the sheet at a temperature of at least about 375° C.

8. A method of producing an aluminum alloy ingot coprising casting an alloy consisting essentially of 2–8% Ca, 1.5–15% Zn, up to 2% each of Mg, Si, Mn and Cu, up to 2% total (up to 1.0% max. each) of other elements, balance Al, for producing from a melt of the alloy a cast mass which includes, in an aluminum matrix, at least 10 volume percent of eutectic Ca-Zn-Al intermetallic rods formed from the melt in the casting operation with an average diameter of 0.05–1.50 microns and breakable, by working of the cast mass, into particles having an average particle diameter of less than two microns, said cast mass being essentially free of coarse primary intermetallic particles.

9. A superplastic aluminum alloy wrought product, constituted of an alloy consisting essentially of 2–8% Ca, 1.5–15% Zn, up to 2% each of Mg, Si, Mn and Cu, up to 2% total (up to 1.0% max. each) of other elements, balance Al; said product comprising a body of the alloy which includes, in an aluminum matrix, a dispersion of Ca-Zn-Al intermetallic particles having an average particle diameter of less than two microns, said particles being fragments of fine eutectic intermetallic rods developed by casting and broken up by working such that the worked alloy, when heated to a forming temperature between about 400° and 500° C., is superplastic.

10. An aluminum alloy consisting essentially of (a) Ca and Zn, the content of Ca and Zn being such that on a rectangular graph of % Zn plotted against % Ca the point representing said content lies within the area of a quadrilateral defined by the coordinates 2.0% Ca, 8.0% Zn; 6.0% Ca, 8.0% Zn; 3.0% Ca, 3.0% Zn; and 7.0% Ca, 3.0% Zn, (b) up to 1.0% each of Si and Mn, up to 0.2% each of Cu and Mg, up to 1.0% total (up to 0.5% max. each) of Fe, Ti, V, Cr, Zr, and Sr, up to 1.0% total (up to 0.25% each) of other elements;

(c) balance Al.

11. A superplastic aluminum alloy wrought product produced by the method of claim 1.

12. A superplastic aluminum alloy wrought product produced by the method of claim 5.

* * * * *